US010428595B2

(12) United States Patent
Bradley et al.

(10) Patent No.: US 10,428,595 B2
(45) Date of Patent: Oct. 1, 2019

(54) QUICK CONNECT SYSTEM FOR SETTING TOOL

(71) Applicant: Hunting Titan, Inc., Pampa, TX (US)

(72) Inventors: Richard Wayne Bradley, Pinehurst, TX (US); Richard Merl Smith, Jr., Whitney, TX (US)

(73) Assignee: Hunting Titan, Inc., Pampa, TX (US)

( * ) Notice: Subject to any disclaimer, the term of this patent is extended or adjusted under 35 U.S.C. 154(b) by 148 days.

(21) Appl. No.: 15/555,823

(22) PCT Filed: Mar. 11, 2016

(86) PCT No.: PCT/US2016/022220

§ 371 (c)(1),
(2) Date: Sep. 5, 2017

(87) PCT Pub. No.: WO2016/145420

PCT Pub. Date: Sep. 15, 2016

(65) Prior Publication Data

US 2018/0087330 A1 Mar. 29, 2018

Related U.S. Application Data

(60) Provisional application No. 62/131,595, filed on Mar. 11, 2015, provisional application No. 62/131,578, (Continued)

(51) Int. Cl.
*E21B 17/046* (2006.01)
*F16L 37/092* (2006.01)
(Continued)

(52) U.S. Cl.
CPC ..... *E21B 17/046* (2013.01); *E21B 17/042* (2013.01); *E21B 23/06* (2013.01);
(Continued)

(58) Field of Classification Search
CPC ..... E21B 17/02; E21B 17/023; E21B 17/04; E21B 17/042; E21B 17/046;
(Continued)

(56) References Cited

U.S. PATENT DOCUMENTS 2,806,538 A * 9/1957 Conrad ..... E21B 23/06 166/123
3,635,501 A * 1/1972 Thorne-Thomsen ..... F16L 37/1215 285/314
(Continued)

FOREIGN PATENT DOCUMENTS

EP 1229211 A2 8/2002
GB 2329656 A 3/1999
(Continued)

OTHER PUBLICATIONS

Notification of Transmittal of the International Search Report and the Written Opinion of the International Searching Authority, PCT Application No. PCT/US2016/02220, dated May 27, 2016, 9 pages.
(Continued)

*Primary Examiner* — Blake E Michener
(74) *Attorney, Agent, or Firm* — Arnold & Saunders, LLP; Christopher McKeon; Jason Saunders

(57) ABSTRACT

A quick connect device for well tools that allows for the connection of two components, such as a setting tool and a plug, without the need for screwing the two components together.

15 Claims, 5 Drawing Sheets

Related U.S. Application Data filed on Mar. 11, 2015, provisional application No. 62/131,503, filed on Mar. 11, 2015.

(51) Int. Cl.

| | |
|---|---|
| ***E21B 17/042*** | (2006.01) |
| ***E21B 23/06*** | (2006.01) |
| *E21B 23/04* | (2006.01) |
| *E21B 33/134* | (2006.01) |

(52) U.S. Cl.

CPC ..... *E21B 23/065* (2013.01); *F16L 37/092* (2013.01); *E21B 23/04* (2013.01); *E21B 33/134* (2013.01)

(58) Field of Classification Search

CPC ..... E21B 17/0423; E21B 17/0426; E21B 17/043; E21B 23/065; E21B 23/06; F16L 37/092; F16L 37/0925

See application file for complete search history.

(56) References Cited

U.S. PATENT DOCUMENTS

| | | | | | |
|---|---|---|---|---|---|
| 3,963,267 | A * | 6/1976 | Legris | F16L 37/0925 | 285/93 |
| 4,045,055 | A * | 8/1977 | Blakely | F16L 37/0925 | 285/110 |
| 4,540,201 | A * | 9/1985 | Richardson | F16L 37/1215 | 285/101 |
| 4,986,690 | A | 1/1991 | Cooksey | | |
| 5,118,140 | A * | 6/1992 | Racine | F16L 37/092 | 285/102 |
| 5,452,923 | A | 9/1995 | Smith | | |
| 5,771,968 | A * | 6/1998 | Danciger | E21B 17/00 | 166/68 |
| 7,618,211 | B2 | 11/2009 | Wood | | |
| 2003/0034647 | A1* | 2/2003 | Hollingsworth | F16L 37/0925 | 285/105 |
| 2005/0183889 | A1 | 8/2005 | Marsh | | |
| 2007/0034381 | A1 | 2/2007 | Campbell et al. | | |
| 2011/0174500 | A1 | 7/2011 | Davies et al. | | |
| 2014/0318809 | A1 | 10/2014 | Joensen et al. | | |
| 2015/0345672 | A1* | 12/2015 | Smith | F16L 37/1215 | 285/81 |

FOREIGN PATENT DOCUMENTS

| | | | | |
|---|---|---|---|---|
| WO | WO-9924752 | A1 * | 5/1999 | F16L 37/0925 |
| WO | 2004093097 | A2 | 10/2004 | |

OTHER PUBLICATIONS

Supplementary European Search Report, Application No. EP16762684, dated Sep. 27, 2018, 4 pages.

Notification concerning transmittal of international preliminary report on patentability, PCT Application No. PCT/US2016/02220, dated Sep. 21, 2017, 7 pages.

* cited by examiner

QUICK CONNECT SYSTEM FOR SETTING TOOL

RELATED APPLICATIONS

This application claims priority to U.S. Provisional Application No. 62/131,503, filed Mar. 11, 2015, U.S. Provisional Application No. 62/131,595 filed Mar. 11, 2015, and to U.S. Provisional Application No. 62/131,578, filed Mar. 11, 2015.

BACKGROUND OF THE INVENTION

Bridge plugs are often introduced or carried into a subterranean oil or gas well on a conduit, such as wire line, electric line, continuous coiled tubing, threaded work string, or the like, for engagement at a pre-selected position within the well along another conduit having an inner smooth inner wall, such as casing. The bridge plug is typically expanded and set into position within the casing. The bridge plug effectively seals off one section of casing from another. Several different completions operations may commence after the bridge plug is set, including perforating and fracturing. Sometimes a series of plugs are set in an operation called "plug and perf" where several sections of casing are perforated sequentially. When the bridge plug is no longer needed the bridge plug is reamed, often though drilling, reestablishing fluid communication with the previously sealed off portion of casing.

Setting a bridge plug typically requires setting a "slip" mechanism that engages and locks the bridge plug with the casing, and energizing the packing element in the case of a bridge plug. This requires large forces, often in excess of 20,000 lbs. The activation or manipulation of some setting tools involves the activation of an energetic material such as an explosive pyrotechnic or black powder charge to provide the energy needed to deform a bridge plug. The energetic material may use a relatively slow burning chemical reaction to generate high pressure gases. One such setting tool is the Model E-4 Wireline Pressure Setting Tool of Baker International Corporation, sometimes referred to as the Baker Setting Tool.

After the bridge plug is set, the explosive setting tool remains pressurized and must be raised to the surface and depressurized. This typically entails bleeding pressure off the setting tool by piercing a rupture disk or releasing a valve.

SUMMARY OF EXAMPLES OF THE INVENTION

An example of an embodiment may include a quick connect device for well tools comprising a substantially cylindrical upper connection body about an axis having a first end and a second end, a resilient member, a pin grip insert having a substantially cylindrical body about an axis, a first end, a second end, an inclined outer surface having larger diameter proximate the first end and a smaller diameter proximate the second end, a threaded inner bore, an upper shoulder orthogonal to the axis, a pin capture socket having a substantially cylindrical body about an axis, a first end, a second end, an inclined inner surface about a conical bore along the axis having a larger diameter proximate the first end and a smaller diameter proximate the second end, wherein the axes of the upper connection body, the pin grip insert, and the pin capture socket are aligned, the pin grip insert is constructed of a plurality of radial segments, the pin grip insert is captured within the conical bore of the pin capture socket, the resilient member is captured between the upper shoulder of the pin grip insert and the second end of the upper connection body, and the upper connection body is affixed to the first end of the pin capture socket.

A variation of the quick connect device may include the resilient member biasing the pin grip insert towards the second end of the pin capture socket. The quick connect device may have the threaded inner bore of the pin grip insert that further comprises buttress threads having the load bearing face oriented toward the first end of the pin grip insert. The quick connect device may have the pin grip insert further comprising a lock screw hole extending radially from the outer surface into each of the plurality of radial segments, the pin capture socket further comprises a plurality of lock screw slots extending from an outer surface of the pin capture socket through the inclined inner surface, a plurality of lock screws extend through the lock screw slots in the pin capture socket and into the lock screw holes in the pin grip insert, securing the pin grip insert inside the pin capture socket.

A variation of the quick connect device may include a plurality of lock screw ramps in the outer surface of the pin capture socket corresponding to and proximate with the plurality of lock screw slots, each having a first end proximate the first end of the pin capture socket at a first distance from the pin capture socket axis and a second end a second, smaller, distance from the axis, wherein the lock screws are adapted to engage the lock screw ramps and couple the longitudinal and axial movement of the pin grip insert segments' movement to the lock screw ramps. The quick connect device may have the lock screw ramps, inner surface of the pin capture socket, and outer surface of the pin grip insert aligned with the same angle relative to the axis.

A variation of the quick connect device may include a holding ring adapted to slide over the outer surface of the pin capture socket having a plurality of lock screw receptacles adapted to couple with a plurality of head portions of the plurality of lock screws, wherein the translation of the holding ring toward the first end of the pin capture socket causes the lock screws and pin grip insert to translate longitudinally and axially, opening the inner threaded bore of the pin grip insert and release of the holding ring allows the resilient member to bias the pin grip insert toward the second end of the pin capture socket, closing the inner threaded bore of the pin grip insert.

A variation of the quick connect device may include the resilient member being a compression spring. A further variation may include the compression spring being a wave spring. The quick connect may further comprise a pin having a first threaded end engaged with the internal threaded bore of the pin grip insert and a second threaded end adapted to engage a well tool. The second threaded end of the pin may be adapted to engage a wellbore plug. The first end of the upper connection body may be adapted to connect to a setting tool. The second end of the upper connection body may be threaded into the first end of the pin capture socket.

Another example of an embodiment of the quick connect device may comprise a capture socket having a substantially cylindrical body about at axis and an inclined inner wall having a first diameter at a first end and smaller second diameter at a second end, a plurality of buttress thread inserts each having a first end, a second end, an inner surface with buttress threads thereon, and an outer surface inclined relative to the inner surface such that the outer surface is closer to the inner surface near the second end than the first end, and an end shoulder proximate the second end, an uphole connection body having a first end and a second end connected to the first end of the capture socket, and a spring, wherein the plurality of buttress thread inserts are arranged inside the capture socket such that their inner surfaces form a continuously threaded hole, the second end of the plurality of buttress thread inserts is near the second end of the capture socket, and the spring is captured and compressed between the second end of the uphole connection body and the end shoulders of the plurality of buttress thread inserts.

An example of an embodiment may include a setting tool for use in setting a bridge plug comprising a housing, an upper piston, an upper cylinder, a lower piston, a lower cylinder, and a piston rod having a circumferential groove adapted to interface with the lower piston via a coupling means, wherein the upper piston and lower piston are hydraulically coupled together.

A variation of the embodiment may include the coupling means being at least one cap screw. The coupling means may be at least two cap screws. The lower piston may comprise two threaded through holes, one hundred and eight degrees opposite of each other. The embodiment may further comprise a crosslink engaged to the piston rod, a crosslink sleeve engaged to the crosslink, and a bridge plug interfaced with the crosslink sleeve. The coupling means may be a spring loaded ball detent. The coupling means may be a pin. The coupling means may be a slotted key.

An example of an embodiment may include an apparatus for use in a setting tool comprising a cylindrical solid piston rod having a first end adapted to interface with a lower piston by sliding into the bore of a lower piston, the piston rod having a circumferential groove proximate to the first end, wherein the lower piston and the piston rod is coupled to the piston rod and the circumferential groove is further adapted to interface with the lower piston via a coupling means.

A variation of the embodiment may include the coupling means being at least one cap screw. The coupling means may be at least two cap screws. The lower piston may further comprise two threaded through holes, one hundred and eight degrees opposite of each other. The embodiment may further comprise the piston rod having a second end adapted to engage a crosslink. The coupling means may be a spring loaded ball detent. The coupling means may be a pin. The coupling means may be a slotted key.

An example of an embodiment may include a method of retrofitting a setting tool that comprising an upper piston, a lower cylinder, a lower piston, a first piston with a through hole, and a crosslink by replacing the first piston with a second piston having a circumferential groove adapted to interface with the lower piston via a coupling means, the method comprising the steps of disassembling the crosslink from the lower cylinder, disassembling the lower cylinder, removing the first piston, installing the second piston, reassembling the lower cylinder; and assembling the crosslink with the lower cylinder.

BRIEF DESCRIPTION OF THE DRAWINGS

For a thorough understating of the present invention, reference is made to the following detailed description of the preferred embodiments, taken in conjunction with the accompanying drawings in which reference numbers designate like or similar elements throughout the several figures. Briefly.

DETAILED DESCRIPTION OF EXAMPLES OF THE INVENTION

In the following description, certain terms have been used for brevity, clarity, and examples. No unnecessary limitations are implied and such terms are used for descriptive purposes only and are intended to be broadly construed. The different apparatus and method steps described herein may be used alone or in combination with other systems and method steps. It is to be expected that various equivalents, alternatives, and modifications are possible within the scope of the presented claims.

Figure 1:
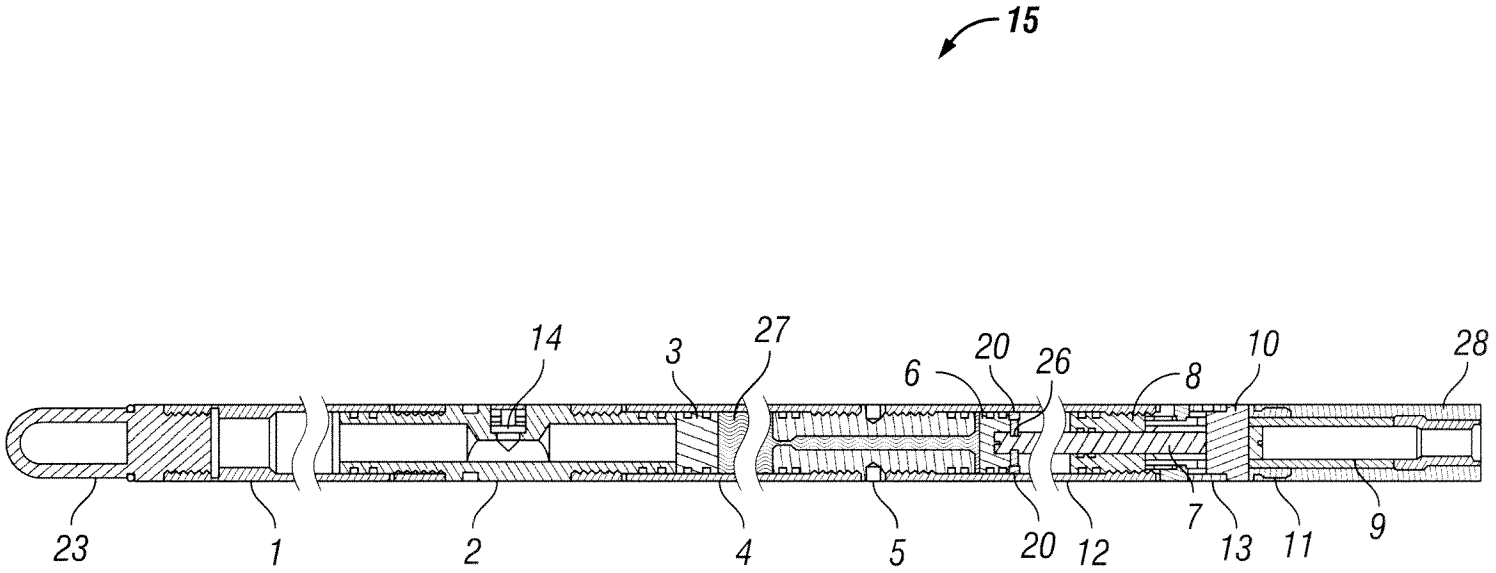
FIG. 1 is cross section of an example wireline setting tool.

An example embodiment is illustrated in the wireline setting tool 15 of FIG. 1. The setting tool 1 includes a ported bleeder sub 2, an upper piston 3, and an upper cylinder 4. A tandem connector 5 connects the upper cylinder 4 with the lower cylinder 12. The lower cylinder 12 contains a lower piston 6, a piston rod 7, and a cylinder head 8. A crosslink 10, crosslink retaining ring 13, and the crosslink sleeve 11 are linked to the lower piston 6 via the piston rod 7. The setting mandrel 9 is fixed to the cylinder head 8 and hence the lower cylinder 12. The setting tool also includes a puncture disc 14 in bleeder sub 2. In this example a pin protector 23 is attached to the end of the setting tool, however the pin protector 23 would be removed during a wireline job and a sub may be attached.

In typical operation a gas generating power charge 1 is electrically ignited. The gases generated by the power charge 1 exert pressure on upper piston 3, which then compresses oil reservoir 27. The oil travels through the tandem connector 5 and exerts pressure on lower piston 6. The resulting movement of lower piston 6 causes piston rod 7 to move as well. Crosslink sleeve 11 is connected to the piston rod 7 via crosslink retaining ring 13 and crosslink 10. As the crosslink sleeve 11 moves in relation to setting mandrel 9, which stays stationary relative to the lower cylinder 12, a setting sleeve 28 of an attached bridge plug also moves. The difference in movement between the crosslink sleeve 11 and the setting mandrel 9 causes a bridge plug to expand and set in the wellbore.

Prior piston rods had a through hole near the end that engages the lower piston. In the prior art these through holes would line up with through holes on opposite radial locations of the lower piston. The piston rod would be inserted into the back end of the lower piston, the holes would be aligned, and a pin would be placed through the aligned holes. It is well known that a through hole acts as a stress concentrator that can cause stresses seen by the rod around the hole to several times higher than the average stress seen in the piston rod. As a result, during operation the through hole on the piston rod deforms due to the pressures exerted on the piston. A single operation may be enough to cause deformation. The pin is generally expected to deform as well, therefore a soft metal must be used in order to make extraction of the pin possible during redress. Typically a hammer and pin are used to force out the warped pin stuck in the warped through hole. In some older designs hard materials were used for the pin, resulting in the piston and piston rod becoming permanently joined.

In this example, the piston rod 7 does not have a typical through hole and pin combination to connect it with the lower piston 6. Instead, in this embodiment it has a circumferential groove 26. Screws 20 engage the retainer groove 26 and fix it to the lower piston 6. A single screw could be used, a plurality of two or more screws could be used. Other fasteners, including spring loaded ball detents could be used as the fastening means in this example. The advantage of this design is that there is no through hole to deform in the piston rod. This results in a stronger piston rod 7 overall. Redress of the setting tool is faster without a stuck piston rod. Further, maintenance cost are reduced as the life of the piston rod is extended. A warped through hole on a piston rod cannot be easily reused.

Alternatives to this example piston rod 7 may include a plurality of circumferential grooves rather than a single groove. Another alternative could be one or more indentations located on the surface of the piston rod 7 in place of a groove. Spring loaded detents or screws could engage the piston to the piston rod via those indentations. In another alternative the set screws could simply tighten against the radial surface of the piston rod 7 without a circumferential groove and rely on friction to keep the lower piston 6 fastened to the piston rod 7.

Figure 2:
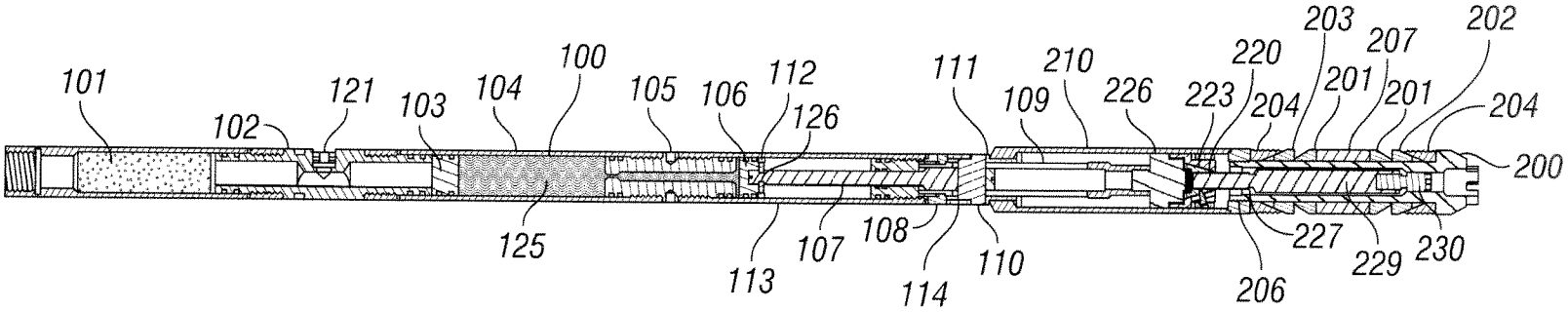
FIG. 2 is a cross section an example a wireline setting tool combined with a quick connector and a bottom set bridge plug.

An example of an embodiment is shown in FIG. 2 including a wireline setting tool 100 combined with a quick connect device 220 and a bottom set bridge plug 200. The wireline setting tool 100 comprises a power charge chamber 101, a ported bleeder sub 102, an upper piston 103, an upper cylinder 104, a tandem connector 105, a lower piston 106, a piston rod 107, a lower cylinder 113, and a cylinder head 108. Ported bleeder sub 102 has a puncture disc 121 for relieving pressure in wireline setting tool 100. The setting mandrel 109 is fixed to the cylinder head 108. A crosslink 110 is connected to the crosslink sleeve 111. A crosslink retaining ring 114 holds the crosslink sleeve 111 in place. A setting sleeve 210 is connected to the crosslink sleeve 111. The setting sleeve 210 and the mandrel 109 can move independently of each other. Lower piston 106 is connected to piston rod 107 using setscrews 112 that engage a circumferential groove 126 cut into the outer surface of the piston rod 107.

A quick connect device 220 connects the mandrel 109 to the bridge plug 200. The quick connect device 220 includes pin grip insert 223, uphole connection 226, and a quick click pin 227. The quick click pin 227 screws into the mandrel 229 of the bridge plug 200.

The bridge plug 200 includes rubber cone with metal backup rings 201, a slip setting ring 202, a slip setting ring 203, a slip 204, a ratchet ring 206, and a rubber seal 207, and the mandrel 229. Shear stud 230 allows the wireline setting tool 100 to separate from the bridge plug 200 after setting.

When the power charge 101 is fired a jet of hot gas will act upon upper piston 103. Upper cylinder 104 is filled with oil 125. The movement of the upper cylinder 104 causes the oil 125 to move through the tandem connector 105 and act against lower piston 106. The movement of lower piston 106 acts against piston rod 107. Piston rod 107 connects to the setting sleeve 210 via the crosslink sleeve 111. As the setting sleeve 210 moves in relation to the setting mandrel 109, the bottom set bridge plug 200 collapses and expands, thus engaging and sealing the borehole casing.

Figure 3:
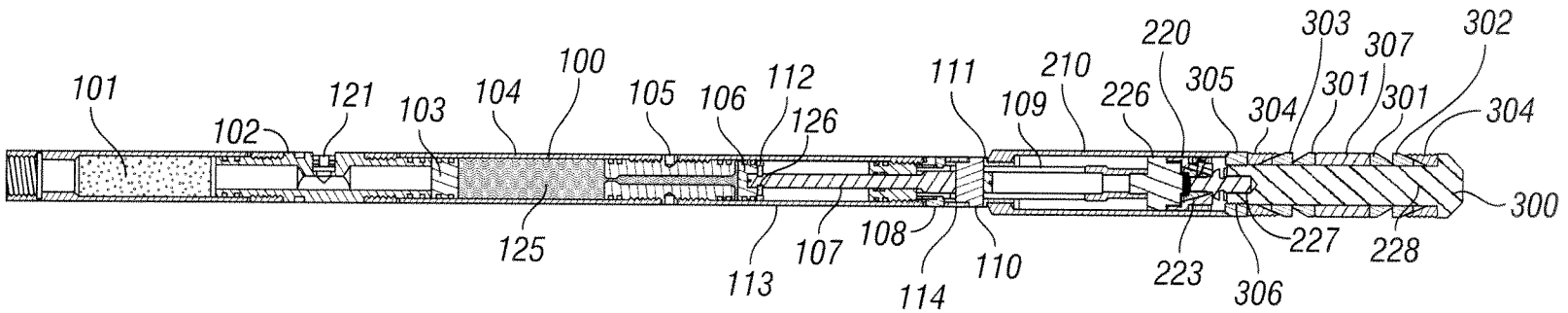
FIG. 3 is a cross section of an example wireline setting tool combined with a quick connector and a top set bridge plug.

Another example of an embodiment is shown in FIG. 3 depiction of a wireline setting tool 100 combined with a quick connect device 220 and a bridge plug 300. The wireline setting tool 100 comprises a power charge chamber 101, a ported bleeder sub 102, an upper piston 103, an upper cylinder 104, a tandem connector 105, a lower piston 106, a piston rod 107, a lower cylinder 113, and a cylinder head 108. Ported bleeder sub 102 has a puncture disc 121 for relieving pressure in wireline setting tool 100. The setting mandrel 109 is fixed to the cylinder head 108. A crosslink 110 is connected to the crosslink sleeve 111. A crosslink retaining ring 114 holds the crosslink sleeve 111 in place. A setting sleeve 210 is connected to the crosslink sleeve 111. The setting sleeve 210 and the mandrel 109 can move independently of each other. Lower piston 106 is connected to piston rod 107 using setscrews 112 that engage a circumferential groove 126 cut into the outer surface of the piston rod 107.

A quick connect device 220 connects the mandrel 109 to the bridge plug 300. The quick connect device 220 includes a pin grip insert 223, uphole connection 226, and a quick click pin 227. The quick click pin 227 screws into the mandrel 228 of the bridge plug 300.

The top set bridge plug 300 includes rubber cone with metal backup rings 301, a slip setting ring 302, a slip setting ring 303, a slip 304, an adapter ring 305, a ratchet ring 306, and a rubber seal 307, and the mandrel 228. The mandrel 228 is for a top set design.

When the power charge 101 is ignited, a jet of hot gas will act upon upper piston 103. Upper cylinder 104 is filled with oil 125. The movement of the upper cylinder 104 causes the oil to move through the tandem connector 105 and act against lower piston 106. The movement of lower piston 106 acts against piston rod 107. Piston rod 107 connects to the setting sleeve 210 via the crosslink 110 and crosslink sleeve 111. As the setting sleeve 210 moves in relation to the setting mandrel 109, the bridge plug 300 collapses and expands, thus engaging and sealing the borehole casing.

Figure 4:
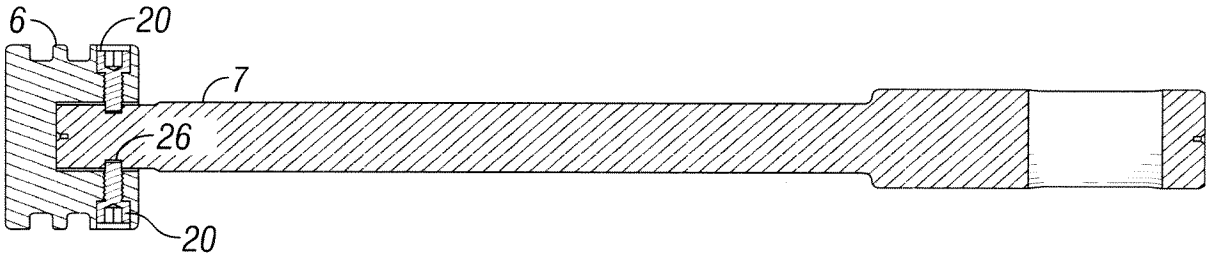
FIG. 4 is a cross section of an example piston rod.

A more detailed example of the piston rod 7 is shown in FIG. 4. The piston rod 7 has circumferential groove 26. Piston rod 7 fits into lower piston 6. Lower piston 6 has one or more through holes for a setscrew 20 to engage with the circumferential groove 26 of piston rod 7. In some applications the fit may have some free play in order to keep the lower piston 6 from binding as it travels in the lower cylinder. Prior art designs would use a through hole in the piston rod and a single pin would engage the piston rod with the lower cylinder. The prior art piston rod experiences tremendous forces when the power charge ignites that collapse or warp the through hole. When the through hole warps it traps the pin and prolong the disassembly process during redress. Redress of the setting tool is slower with a stuck piston rod. Typically a warped pin needs to be hammered out in order to disengage the lower piston from the piston rod. Maintenance cost are increased because a warped piston rod must be replaced instead of reused.

The example shown in FIG. 4 prevents the failure modes known in the prior art by relying on the circumferential groove 26 and setscrews 20. The advantage of this design is that there is no through hole to deform in the piston rod. This results in a stronger piston rod 7 overall. Alternatively, a single screw could be used or a plurality of two or more screws could be used. Other fasteners, including spring loaded ball detents, slotted keys, cap screws, set screws, or cotter pins could be used as the fastening means in this example. Alternatives to this example piston rod 7 may include a plurality of circumferential grooves rather than a single groove. Another alternative could be one or more indentations located on the surface of the rod 7 in place of a groove. Spring loaded detents or screws could engage the piston to the piston rod via those indentations. In another alternative the set screws could simply tighten against the radial surface of the piston rod 7 without a circumferential groove and rely on friction to keep the lower piston 6 fastened to the piston rod 7.

Figure 5:
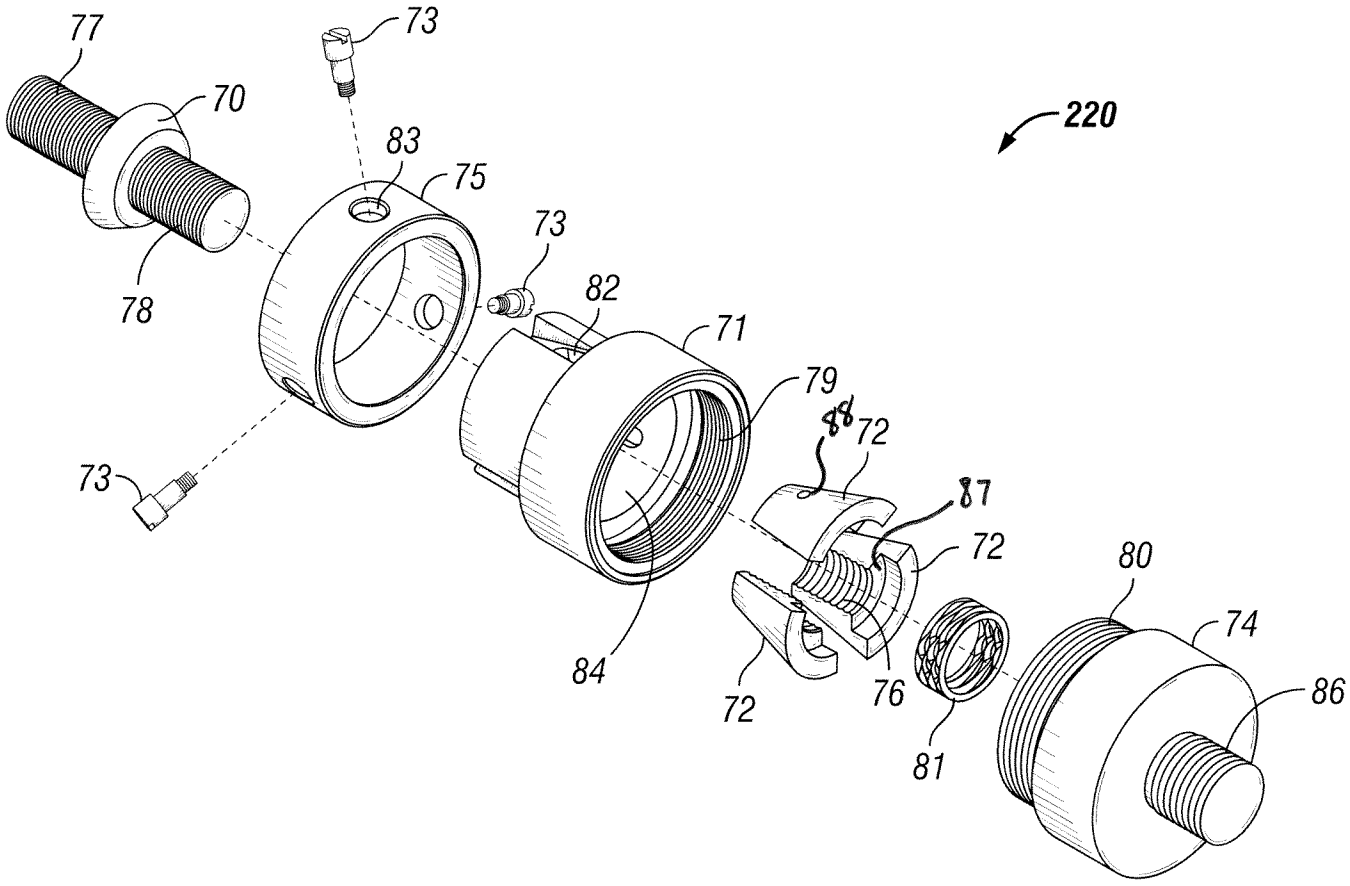
FIG. 5 is an exploded assembly drawing of an example quick connector.
Figure 6:
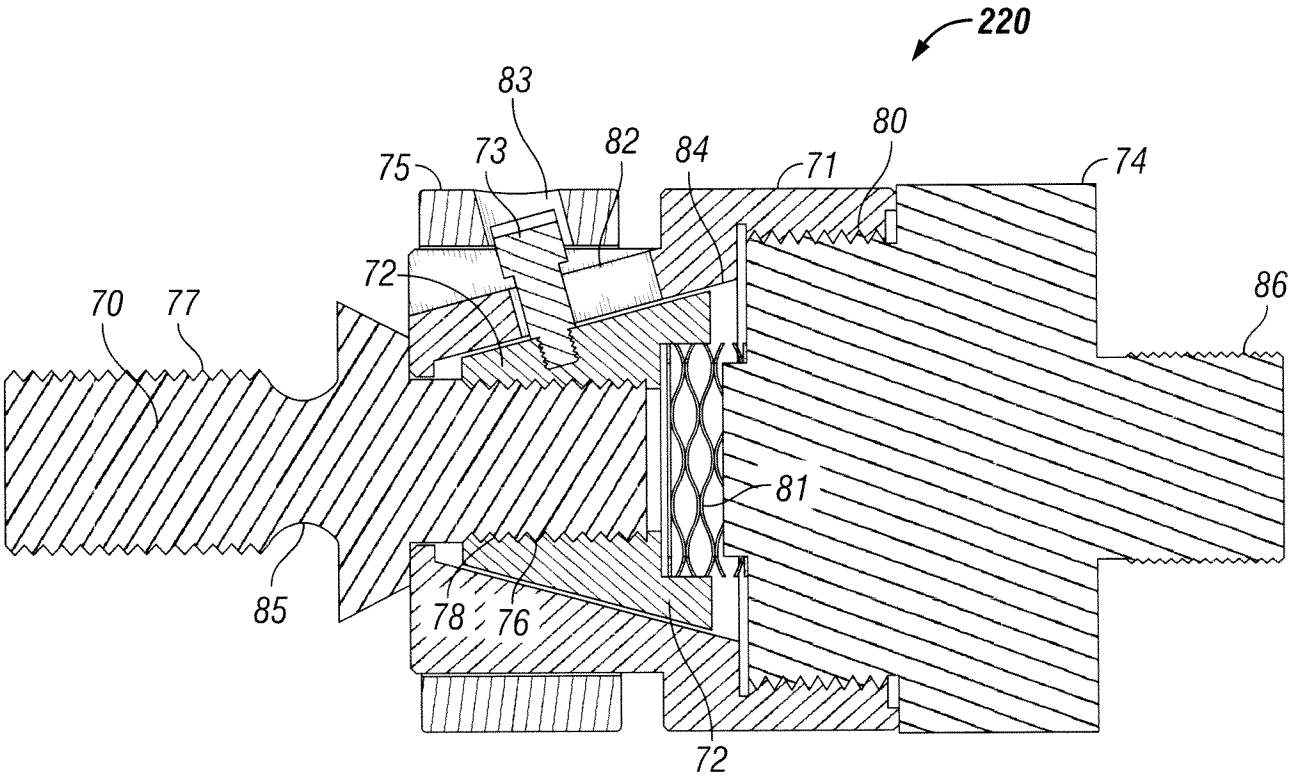
FIG. 6 is a cross section of an example quick connector assembly.

Quick connect device 220 for connecting a bridge plug to a wireline setting tool is shown in FIG. 5 and FIG. 6. The quick connect device 220 has a pin capture socket 71 that has a threaded inner bore 84. In this configuration three pin grip inserts 72 are located within the pin capture socket 71. The pin grip inserts 72 are held in place by resilient member 81, which may be a spring, wave spring, compression spring, or some other similar device. The pushing action by the resilient member 81 in combination with the inclined inner surface 84 causes the pin grip inserts 72 to come together. Resilient member 81 forces longitudinal movement of the three pin grip insert 72 along the inclined inner surface 84 of the pin capture socket 71. Upper connection body 74 screws into the pin capture socket 71 using male threads 80 on the uphole connection with female threads 79 on the pin capture socket 71. Threads 86 are adapted to connect to a mandrel of a wireline setting tool. Holding ring 75 fits over the pin capture socket 71. Holding ring 75 in this example has three through holes 83. The through holes 83 are lined up with the corresponding slots 82 on the pin capture socket 71. Three set screws 73 are used in this example to engage the holding ring 75 with the three pin grip inserts 72 via lock screw slots 82.

Each pin grip insert 72 has inner threads 76. In this example the threads 76 are buttress threads, which are designed to mate to corresponding buttress threads 78 on pin 70. When the quick connect device 220 is fully assembled, the pin 70 can easily slide into the pin grip inserts 72, and are locked due to the spring action of resilient member 81. Thus, pin 70 can be inserted but not removed from the quick connect device 220 without relief from the resilient member 81. Moving holding ring 75 away from the pin 70 counteracts the resilient member 81, allowing the pin grip inserts 72 to separate, thus releasing pin 70.

Alternatives to the embodiment disclosed in FIGS. 5 and 6 include two tapered pin grips instead of three, or more than three tapered pin grips. The threads do not have to be buttress threads The benefits of this quick connect device 220 design include the ease of assembly large and heavy components, such as bridge plugs, when putting together a complete wireline setting tool assembly. Threading a large and heavy bridge plug to a hanging wireline setting tool can be difficult. Using a quick connect device 220, pin 70 is threaded into the bridge plug using threads 77. The quick connect device 220 is threaded into a wireline setting tool using threads 86. When the wireline setting tool is hanging on the rig, the bridge plug with pin 70 installed can simply slide into the pin capture socket 71 of the quick connect device 220 and lock into place. This single movement does not require any rotation of the bridge plug, thread alignment, or special orientation to get the bridge plug secured. The tapered pin grips automatically lock the bridge plug into place regardless of radial orientation of the bridge plug. As a result, all that is required is a single translation of the bridge plug and pin 70 into the pin capture socket 71. After the bridge plus is set downhole, the wireline setting tool is pulled up until pin 70 shears at the narrow neck 85 as shown in FIG. 6. After retrieval of the wireline setting tool, the sheared pin 70 is removed from the quick connect device 220.

An example of an embodiment may include a quick connect device 220 for well tools comprising a substantially cylindrical upper connection body 74 about an axis having a first end and a second end, a resilient member 81, a pin grip insert 72 having a substantially cylindrical body about an axis, a first end, a second end, an inclined outer surface having larger diameter proximate the first end and a smaller diameter proximate the second end, a threaded inner bore 76, an upper shoulder 87 orthogonal to the axis, a pin capture socket 71 having a substantially cylindrical body about an axis, a first end, a second end, an inclined inner surface 84 about a conical bore along the axis having a larger diameter proximate the first end and a smaller diameter proximate the second end, wherein the axes of the upper connection body 74, the pin grip insert 72, and the pin capture socket 71 are aligned, the pin grip insert 72 is constructed of a plurality of radial segments, the pin grip insert 72 is captured within the conical bore of the pin capture socket 71, the resilient member 81 is captured between the upper shoulder 87 of the pin grip insert 72 and the second end of the upper connection body 74, and the upper connection body 74 is affixed to the first end of the pin capture socket 71.

A variation of the quick connect device 220 may include the resilient member 81 biasing the pin grip insert 72 towards the second end of the pin capture socket 71. The quick connect device 220 may have the threaded inner bore 76 of the pin grip insert 72 that further comprises buttress threads having the load bearing face oriented toward the first end of the pin grip insert 72. The quick connect device 220 may have the pin grip insert 72 further comprising a lock screw hole 88 extending radially from the outer surface into each of the plurality of radial segments, the pin capture socket 71 further comprises a plurality of lock screw slots 82 extending from an outer surface of the pin capture socket 71 through the inclined inner surface 84, a plurality of lock screws 73 extend through the lock screw slots 82 in the pin capture socket 71 and into the lock screw holes 88 in the pin grip insert 72, securing the pin grip insert 72 inside the pin capture socket 71.

A variation of the quick connect device 220 may include a plurality of lock screw ramps in the outer surface of the pin capture socket 71 corresponding to and proximate with the plurality of lock screw slots 82, each having a first end proximate the first end of the pin capture socket 71 at a first distance from the pin capture socket 71 axis and a second end a second, smaller, distance from the axis, wherein the lock screws 73 are adapted to engage the lock screw ramps and couple the longitudinal and axial movement of the pin grip insert 72 segments' movement to the lock screw ramps. The quick connect device 220 may have the lock screw ramps, inner surface of the pin capture socket 71, and outer surface of the pin grip insert 72 aligned with the same angle relative to the axis.

A variation of the quick connect device 220 may include a holding ring adapted to slide over the outer surface of the pin capture socket 71 having a plurality of lock screw receptacles adapted to couple with a plurality of head portions of the plurality of lock screws 73, wherein the translation of the holding ring toward the first end of the pin capture socket 71 causes the lock screws 73 and pin grip insert 72 to translate longitudinally and axially, opening the inner threaded bore of the pin grip insert 72 and release of the holding ring allows the resilient member 81 to bias the pin grip insert 72 toward the second end of the pin capture socket 71, closing the inner threaded bore of the pin grip insert 72.

A variation of the quick connect device 220 may include the resilient member 81 being a compression spring. A further variation may include the compression spring being a wave spring. The quick connect may further comprise a pin 70 having a first threaded end 78 engaged with the threaded inner bore 76 of the pin grip insert 72 and a second threaded end 77 adapted to engage a well tool. The second threaded end 77 of the pin 70 may be adapted to engage a wellbore plug. The first end 81 of the upper connection body 74 may be adapted to connect to a setting tool. The second end 80 of the upper connection body 74 may be threaded into the first end of the pin capture socket 71.

Another example of an embodiment of the quick connect device 220 may comprise a capture socket having a substantially cylindrical body about at axis and an inclined inner wall having a first diameter at a first end and smaller second diameter at a second end, a plurality of buttress thread inserts each having a first end, a second end, an inner surface with buttress threads thereon, and an outer surface inclined relative to the inner surface such that the outer surface is closer to the inner surface near the second end than the first end, and an end shoulder proximate the second end, an uphole connection body having a first end and a second end connected to the first end of the capture socket, and a spring, wherein the plurality of buttress thread inserts are arranged inside the capture socket such that their inner surfaces form a continuously threaded hole, the second end of the plurality of buttress thread inserts is near the second end of the capture socket, and the spring is captured and compressed between the second end of the uphole connection body and the end shoulders of the plurality of buttress thread inserts.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A quick connect device for well tools comprising:

a substantially cylindrical upper connection body about an axis having a first end and a second end;

a resilient member;

a pin grip insert having a substantially cylindrical body about an axis, a first end, a second end, an inclined outer surface having larger diameter proximate the first end and a smaller diameter proximate the second end, a continuously threaded inner bore, an upper shoulder orthogonal to the axis;

a pin capture socket having a substantially cylindrical body about an axis, a first end, a second end, an inclined inner surface about a conical bore along the axis having a larger diameter proximate the first end and a smaller diameter proximate the second end;

wherein the axes of the upper connection body, the pin grip insert, and the pin capture socket are aligned, the pin grip insert is constructed of a plurality of radial segments, the pin grip insert is captured within the conical bore of the pin capture socket, the resilient member is captured between the upper shoulder of the pin grip insert and the second end of the upper connection body, and the upper connection body is affixed to the first end of the pin capture socket.

2. The quick connect device of claim 1 wherein the resilient member biases the pin grip insert towards the second end of the pin capture socket.

3. The quick connect device of claim 2 wherein the threaded inner bore of the pin grip insert comprises buttress threads having the load bearing face oriented toward the first end of the pin grip insert.

4. The quick connect device of claim 2 wherein:

the pin grip insert further comprises a lock screw hole extending radially from the outer surface into each of the plurality of radial segments;

the pin capture socket further comprises a plurality of lock screw slots extending from an outer surface of the pin capture socket through the inclined inner surface;

a plurality of lock screws extend through the lock screw slots in the pin capture socket and into the lock screw holes in the pin grip insert, securing the pin grip insert inside the pin capture socket.

5. The quick connect device of claim 4 further comprising:

a plurality of lock screw ramps in the outer surface of the pin capture socket corresponding to and proximate with the plurality of lock screw slots, each having a first end proximate the first end of the pin capture socket at a first distance from the pin capture socket axis and a second end a second, smaller, distance from the axis;

wherein the lock screws are adapted to engage the lock screw ramps and couple longitudinal and axial movement of the pin grip insert segments' movement to the lock screw ramps.

6. The quick connect device of claim 5 wherein the lock screw ramps, inner surface of the pin capture socket, and outer surface of the pin grip insert have the same angle relative to the axis.

7. The quick connect device of claim 6 further comprising:

a holding ring adapted to slide over the outer surface of the pin capture socket having a plurality of lock screw receptacles adapted to couple with a plurality of head portions of the plurality of lock screws;

wherein translation of the holding ring toward the first end of the pin capture socket causes the lock screws and pin grip insert to translate longitudinally and axially, opening the inner threaded bore of the pin grip insert and release of the holding ring allows the resilient member to bias the pin grip insert toward the second end of the pin capture socket, closing the inner threaded bore of the pin grip insert.

8. The quick connect device of claim 7 wherein the resilient member is a compression spring.

9. The quick connect of claim 8 further comprising a pin having a first threaded end engaged with the internal threaded bore of the pin grip insert and a second threaded end adapted to engage a well tool.

10. The quick connect of claim 9 wherein the second threaded end of the pin is adapted to engage a wellbore plug.

11. The quick connect of claim 10 wherein the first end of the upper connection body is adapted to connect to a setting tool.

12. The quick connect of claim 11 wherein the compression spring is a wave spring.

13. The quick connect of claim 8 where the second end of the upper connection body is threaded into the first end of the pin capture socket.

14. A quick connect for downhole well tools comprising:

a capture socket having a substantially cylindrical body about an axis and an inclined inner wall having a first diameter at a first end and smaller second diameter at a second end;

a plurality of buttress thread inserts each having a first end, a second end, an inner surface with buttress threads thereon, and an outer surface inclined relative to the inner surface such that the outer surface is closer to the inner surface near the second end than the first end, and an end shoulder proximate the second end;

an uphole connection body having a first end and a second end connected to the first end of the capture socket;

a spring;

wherein the plurality of buttress thread inserts are arranged inside the capture socket such that their inner surfaces form a continuously threaded hole, the second end of the plurality of buttress thread inserts is near the second end of the capture socket, and the spring is captured and compressed between the second end of the uphole connection body and the end shoulders of the plurality of buttress thread inserts.

15. A quick connect for downhole well tools comprising:

a capture socket having a substantially cylindrical body about an axis and an inclined inner wall having a first diameter at a first end and smaller second diameter at a second end;

a segmented buttress thread insert having a substantially cylindrical body, a first end, a second end, an inner bore with continuous buttress threads therein, and an outer surface inclined relative to the inner surface such that the outer surface is closer to the inner surface near the second end than the first end, and an end shoulder proximate the second end, wherein the body is formed of a plurality of radial sections;

an uphole connection body having a first end and a second end connected to the first end of the capture socket;

a spring;

wherein the segmented buttress thread insert is inside the capture socket, the second end of the buttress thread insert is near the second end of the capture socket, and the spring is captured and compressed between the second end of the uphole connection body and the end shoulder of the of buttress thread insert.

* * * * *